US006799818B2

(12) United States Patent
Ahmed et al.

(10) Patent No.: US 6,799,818 B2
(45) Date of Patent: Oct. 5, 2004

(54) TILTABLE STORAGE MODULE FOR REFRIGERATOR

(75) Inventors: Rania Mohanna Ahmed, Louisville, KY (US); Donald G. Falk, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,904

(22) Filed: Oct. 31, 2001

(65) Prior Publication Data

US 2003/0080661 A1 May 1, 2003

(51) Int. Cl.[7] ..... A47B 96/04
(52) U.S. Cl. ..... 312/405.1; 312/321.5
(58) Field of Search ..... 312/404, 405.1, 312/327, 328, 298, 321.5, 248; 211/90.02, 150; 248/185.1, 291.1, 240, 240.1

(56) References Cited

U.S. PATENT DOCUMENTS 1,675,718 A * 7/1928 Lynch ..... 40/657
2,976,101 A * 3/1961 Rooney ..... 312/300
4,775,201 A 10/1988 Thomson
5,269,599 A * 12/1993 Moring ..... 312/290
5,303,997 A 4/1994 Kropf
5,361,978 A * 11/1994 Monroe ..... 232/43.1
5,513,910 A * 5/1996 Ellingwood et al. ..... 312/405.1
6,062,416 A * 5/2000 Smillie ..... 220/524

FOREIGN PATENT DOCUMENTS

FR 1116644 * 5/1956 ..... 312/298
IT 644966 * 9/1962 ..... 312/328

* cited by examiner

*Primary Examiner*—Janet M. Wilkens
(74) *Attorney, Agent, or Firm*—H. Neil Houser, Esq.; Armstrong Teasdale LLP

(57) ABSTRACT

A storage module for a refrigeration appliance includes a base having opposing side supports and a basket hingedly coupled to said side supports and tiltable about a rotational axis therethrough.

17 Claims, 5 Drawing Sheets

TILTABLE STORAGE MODULE FOR REFRIGERATOR

BACKGROUND OF INVENTION

This invention relates generally to refrigeration appliances, and, more particularly, to storage bin and basket modules for use in refrigeration appliances.

Known refrigeration appliances, including refrigerators and freezers, typically include a cabinet housing including an outer case and one or more inner liners therein that defines a refrigeration compartment, such as a fresh food compartment and a freezer compartment for storing food and beverage items. The fresh food compartment and freezer compartments are closed by separate access doors hingedly attached to the case. A number of storage shelves, baskets, and drawers are employed in the fresh food compartment to organize food. See, for example, U.S. Pat. No. 5,584,551.

Furthermore, storage bin shelves are often integrated into the refrigerator access doors for storage of food and beverage items. Thus, for example, condiments and bottles may be stored in the fresh food compartment door, and frozen juice concentrates and frozen vegetables may be stored in the freezer compartment door rather than in the fresh food and freezer compartments. As such, the items in the door storage bins are accessible apart from the fresh food and freezer compartments when the doors are opened yet located in the refrigeration compartments when the doors are closed.

In some type of side-by-side refrigerators, multiple storage bin shelves are integrated in a vertically stacked orientation relative to one another. The size of the shelves and the spacing between them, however, can be restrictive for loading and unloading items to and from the storage bins. Larger items and oddly shaped items are therefore difficult to load and unload from the storage door shelves, and several manipulations of the items are required to fit items into and remove the items from the storage door. For example, taller items must be tilted about their lower ends to fit them into door storage bins and then rotated back to a level position in the bins. Smaller items may not be loaded or unloaded with one smooth movement either, but must rather be positioned in the door storage shelves with both a horizontal movement and a vertical movement. Still further, access door storage shelves can be difficult to clean.

The aforementioned difficulties are more pronounced when shelves and bins are located in lower portions of the door where they are neither easily reached nor in a clear line of sight for the user.

SUMMARY OF INVENTION

In one aspect, a storage module for a refrigeration appliance is provided. The storage module comprises a base comprising opposing side supports and a basket hingedly coupled to said side supports and tiltable about a rotational axis therethrough.

In another aspect, a modular storage bin for an access door of a refrigeration appliance is provided. The bin comprises a module base comprising first and second side supports configured for attachment to the access door, at least one hinge rotatably coupled to one of said first and second side supports, and a storage basket coupled to said hinge and tiltable relative to said base side supports.

In still another aspect, a modular storage bin for an access door of a refrigeration appliance is provided. The bin comprises a module base comprising first and second side supports configured for attachment to the access door, at least one hinge rotatably coupled to one of said first and second side supports, and a storage basket comprising at least bottom and front sides. The bottom of said basket is received in said hinge adjacent said front side, and the basket is selectively positionable between a substantially upright closed position and a tilted open position.

In an additional aspect, a modular storage bin for an access door of a refrigeration appliance is provided. The bin comprises a module base comprising first and second side supports configured for attachment to the access door and a floor extending between said first and second side supports. The side supports comprise a basket stop portion, and a hinge is rotatably coupled to each of said first and second side supports, each said hinge comprising a neck portion and a channel portion extending therefrom. A storage basket comprises a frame comprising a front side, a bottom and first and second corners extending therebetween. The basket corners are positioned adjacent each of said module base side supports, and the basket frame is received in said hinges adjacent said corners. The basket is tiltable about said hinges between a substantially upright position wherein said basket is separated from said basket stop portion and a tilted position wherein said basket contacts said basket stop portion.

In yet another aspect, a refrigeration appliance is provided: The appliance comprises a cabinet, a refrigeration compartment liner within said cabinet and comprising at least one refrigeration compartment, and at least one access door coupled to said cabinet for closing said refrigeration compartment. The access door comprises at least a shelf side support, and a modular storage bin is coupled to said access door shelf side support. The storage bin comprises at least one hinge supported by said shelf side support and a basket received in said hinge. The basket is rotatable about said hinge between an upright closed position and a tilted open position providing a direct line of access into said basket.

DETAILED DESCRIPTION

Figure 1:
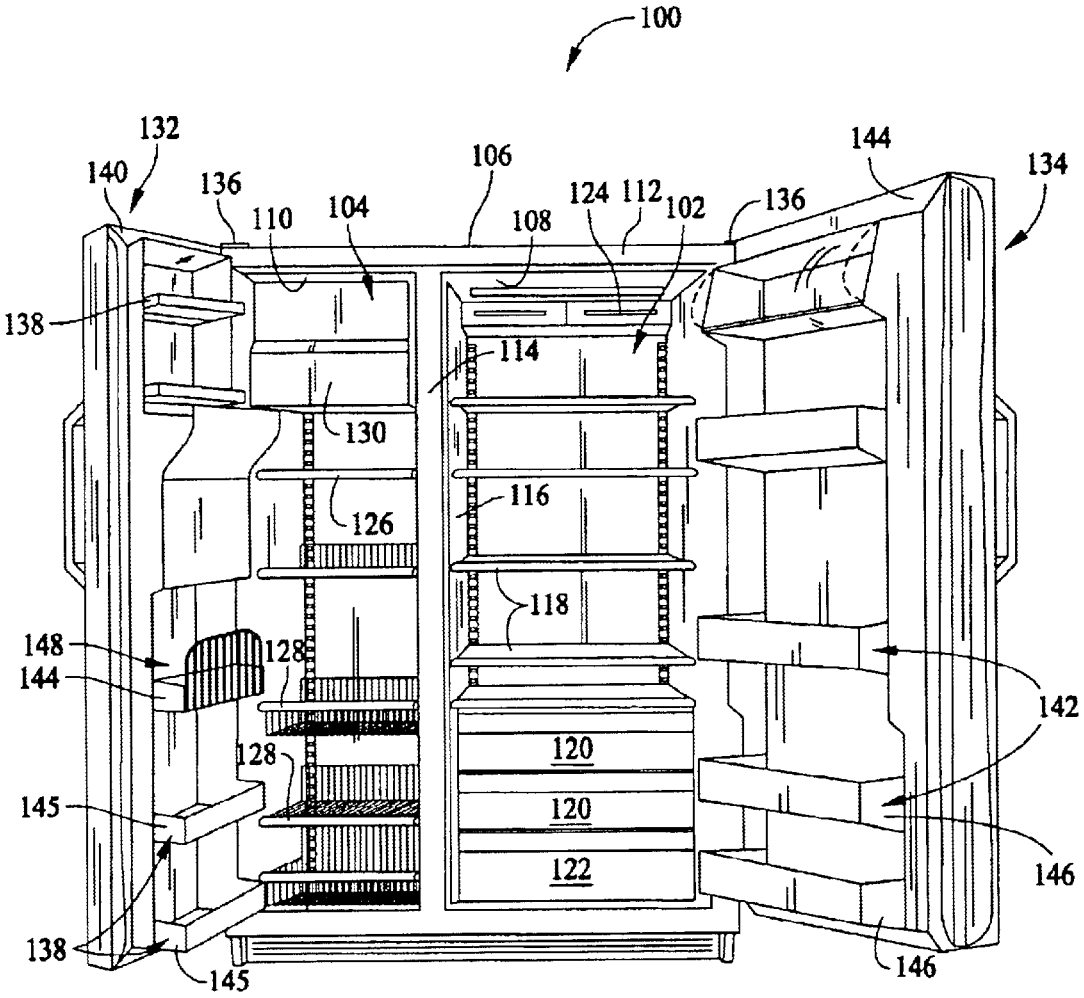
FIG. 1 is a perspective view of an exemplary refrigerator.

FIG. 1 illustrates an exemplary refrigeration appliance 100 in which the present invention may be practiced. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 100 includes a fresh food storage compartment 102 and a freezer storage compartment 104. Freezer compartment 104 and fresh food compartment 102 are arranged side-by-side within an outer case 106 and defined by inner liners 108 and 110 therein. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out storage drawers 120, sometimes referred to as storage pans, normally are provided in fresh food compartment 102 to support items being stored therein.

Refrigerator 100 is controlled by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104. In addition, an ice maker 130 may be provided in freezer compartment 104.

In accordance with known refrigerators, refrigerator 100 includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Door shelves 138, 142 are formed into respective access doors 132, 134 and are partly defined by shelf supports 145, 146, respectively depending inwardly from each access door 132, 134 such that when access doors 132, 134 are closed, door shelves 138, 142 are located within freezer compartment 104 and fresh food compartment 102, respectively. Door shelves 138, 142 are vertically aligned in a stacked arrangement to maximize refrigeration compartment space.

When refrigerator 100 is well stocked with food items, door shelves 138, 142 located in lower portions of access doors 132, 134, however, can be difficult to load food items therein and difficult to unload items therefrom due to relatively close proximity to one another and an obstructed view of lower shelves 138, 142 by upper shelves 138, 142. Placement into and retrieval of items from the door shelves often entails a series of awkward, disjointed movements. These difficulties are largely overcome with a modular tilitable storage bin 148 attached to door side supports 145. As explained more fully below, tiltable storage bin module 148 is selectively positionable between an upright closed position and a tilted open position providing a direct line of access and clear visibility into bin module 148 that facilitates placement of items into bin module 148 and easy retrieval of items from bin module 148 without awkward and complicated movements.

While refrigerator 100 is illustrated with a single tiltable bin module 148 coupled to freezer door 132, it is anticipated that a plurality of bin modules 148 may employed in freezer door 132 and/or fresh food door 134 to increase user convenience and customer satisfaction. For example, in illustrative embodiments, one, two, three or four bin modules 148 are employed in a single acees door, although even greater numbers of modules 148 may be employed without departing from the scope and spirit of the present invention. Also, while it is appreciated that the benefits of the invention are most apparent in door shelves 138, 142 in the lowest portions of access doors 132, 134, bin module 148 is believed to be beneficial when employed in upper regions of access doors 132, 134 as well. As such, the embodiment shown in FIG. 1 is provided for illustrative purposes only, and the invention is in now way intended to be restricted to practice in any particular access door or in any particular location in a refrigeration compartment.

Figure 2:
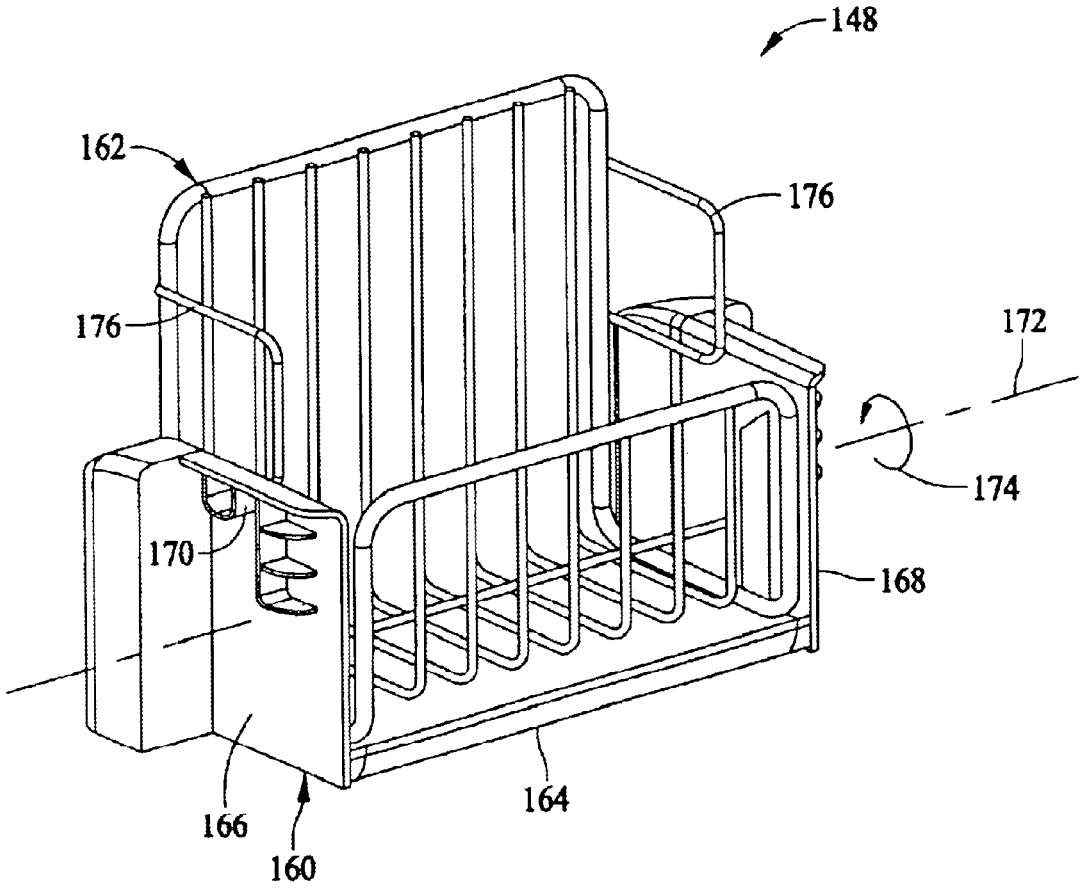
FIG. 2 is a perspective view of a tiltable storage bin module for the refrigerator shown in FIG. 1.

FIG. 2 is a rear perspective view of tiltable storage bin module 148 including a module base 160 and a storage basket 162 coupled thereto. Module base includes a bottom or floor 164 extending substantially horizontally and first and second side supports 166, 168 extending from opposite lateral ends of module floor 164. Base side support 166, 168 each include a rear portion (described further below) including a slot 170 that receives a complementary projection of an access door shelf support, such as supports 145, 146 (shown in FIG. 1) with press fit engagement. Storage basket 162 is coupled to a forward inner wall (described below) of base side supports 166, 168 via hinges (described further below) that allow basket 162 to be rotated forward about an axis 172 through basket 162 in the direction of arrow 174 such that basket 162 is tilted forward relative to module base 160 for direct access and a generally unobstructed line of sight into storage basket 162, even when storage basket is located in a lower portion of an access door, such as doors 132, 134 (shown in FIG. 1).

Basket 162 is of a wire frame construction and includes side rails 176 aligned with and extending above base side supports 166, 168 to prevent items from falling out of basket 162 as basket 162 is selectively positioned between an upright closed position illustrated in FIG. 2 and an open position (not shown) wherein basket is tiled forward a specified amount. By pulling basket 162 forward, basket 162 is rotated about axis 172 to a tilted open position relative to module base 160. When basket 162 is released from the open position, basket 162 naturally returns to the closed position, as described in more detail below.

Figure 3:
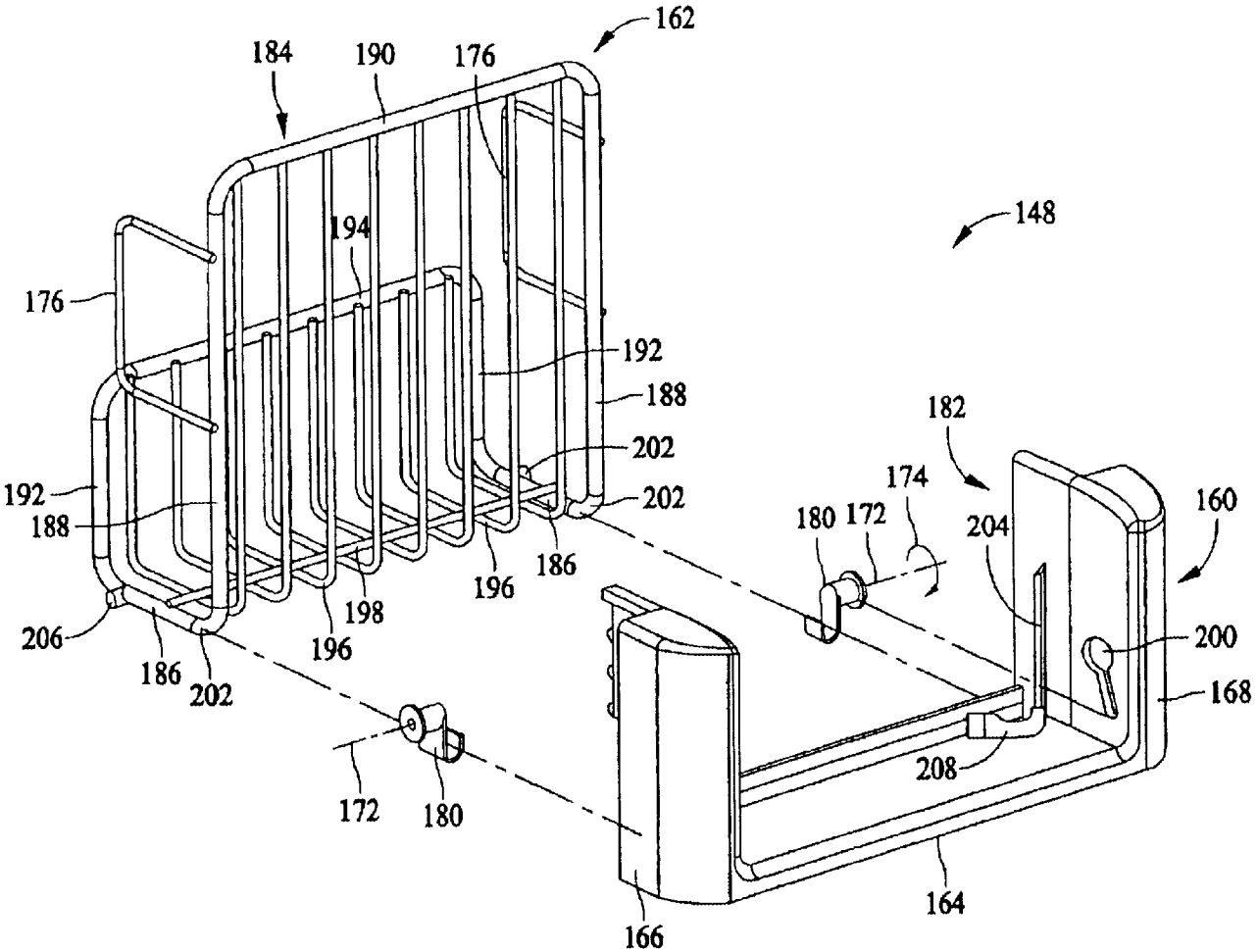
FIG. 3 is an assembly view of the tiltable storage bin module shown in FIG. 2.

FIG. 3 is a front assembly view of tiltable storage bin module 148 including module base 160, storage basket 162, and hinges 180. Base 160 includes floor 164 and side supports 166, 168 forming a generally rectangular channel 182 therebetween in which basket 162 is received. Basket 162 includes a frame 184 including spaced apart bottom members 186, spaced apart front members 188 extending from front ends of frame bottom members 186, and a top member 190 extending between respective ends of spaced apart frame front members 188. Frame 184 further includes back members 192 extending from back ends of frame bottom members 186 for a lesser length than frame front members 188, and a back rail member 194 extending between respective ends of frame back members 192. A plurality of aligned U-shaped wire members 196 extend between frame top member 190 and frame back rail 194 and are connected by a cross member 198 extending between frame bottom members 186, thereby forming an open box-like basket container between frame front members 188 and frame rear members 192.

Hinges 180 are each received in a keyway opening 200 located in a forward portion (described below) of each module base side support 166, 168. Basket 162 is coupled to hinges 180 adjacent front corners 202 of basket frame 184 extending between frame front members 188 and frame back members 192. As such, basket 162 is rotatable about axis 172 through hinges 180 when hinges 180 are attached to base module side supports 166, 168, thereby allowing basket 162 to tilt relative to module base 160 when basket handles 176 are engaged and pulled forward.

Because of attachment of basket 162 to hinges 180 at basket front corners 202, gravitational forces return basket 162 to the closed position illustrated in FIG. 2 and maintain basket 102 in an upright closed position wherein basket frame bottom members 186 are positioned above, and separated from, base module floor 164. Ribs 204 are formed into an inner rear portion of each side support 166, 168 and serve as basket stops that prevent basket 162 from tilting beyond a predetermined point. More specifically, lateral projections 206 extend from basket frame bottom members 186 that engage base side support ribs 204 as basket is rotated forward about axis 172. In an illustrative embodiment, ribs 204 and basket frame projections 206 are dimensioned and oriented to one another to allow a rotation of basket 162 of approximately 35°, although it is appreciated that greater or lesser degrees of rotation may be facilitated in alternative embodiments.

Basket supports 208 extend upwardly from base floor 164 adjacent each base side support 166, 168 to support basket 182 in the closed upright position wherein basket frame bottom members are positioned substantially horizontally above base floor 164 and basket frame front and back members 188, 192 extend substantially vertically within base module channel 182.

Figure 4:
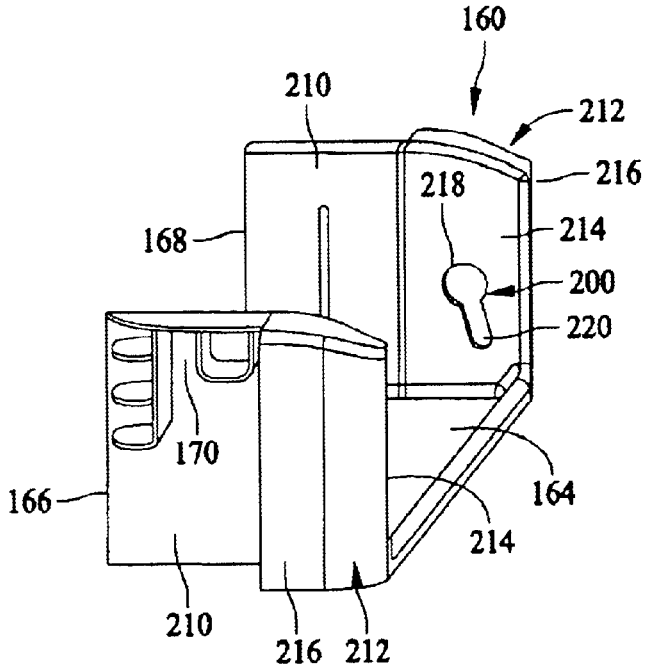
FIG. 4 is a perspective view of a portion of the tiltable storage bin module shown in FIGS. 2 and 3.

FIG. 4 is a perspective view of module base 160 with basket 162 (shown in FIGS. 2 and 3) removed. A generally rectangular door access slot 170 extends from an outer surface of a rear portion 210 of each module base side support 166, 168 in an exemplary embodiment. In an illustrative embodiment, door access slot 170 is defined by outwardly depending projections or ribs 211 depending from an outer surface of side support rear portions 210. Door access slots 170 interface with a square projection of access door shelf supports, such as supports 145 and 146 (shown in FIG. 2), to securely couple module base 160 to an access door, such as doors 132, 134 (shown in FIG. 1) with a sliding engagement that facilitates both hand installation and hand removal of module base to and from an access door without tools. Basket stop ribs 204 extend from an in inner surface of side support rear portions 210 and prevent basket 162 (shown in FIG. 3) from tilting beyond a predetermined point, as described above.

A forward portion 212 of each side support extends from rear portions 210 and is thicker than side support rear portions 210 such that side support rear portions 210 are recessed relative to side support front portions 212 and therefore not visible when module base 160 is installed in a refrigeration appliance access door, such as doors 132, 134 (shown in FIG. 1). Side support forward portions 212 are contoured to provide a pleasing appearance of module base 160 and include an inner wall 214 and an outer wall 216. Keyway openings 200 extends through inner walls 214 but not outer walls 216 so that hinges 180 (shown in FIG. 3) are hidden by outer walls 216 both for safety purposes as basket 162 is rotated and also to preserve a pleasing appearance.

Hinge keyway openings 200 are positioned generally adjacent a front face of base module 160 in each base side support 166, 168. Each keyway includes a generally circular head portion 218 and a neck portion 220 extending downward toward base floor 164 and also toward the front face of base module. As such, when hinges 180 are inserted through keyway openings 200 and basket 162 is attached to basket frame front corners 202, frame front members 188 (shown) are substantially flush with the module base front face.

In an exemplary embodiment, module base 160 is fabricated with known plastic materials according to known methods and techniques, including but not limited to injection molding processes.

Figure 5:
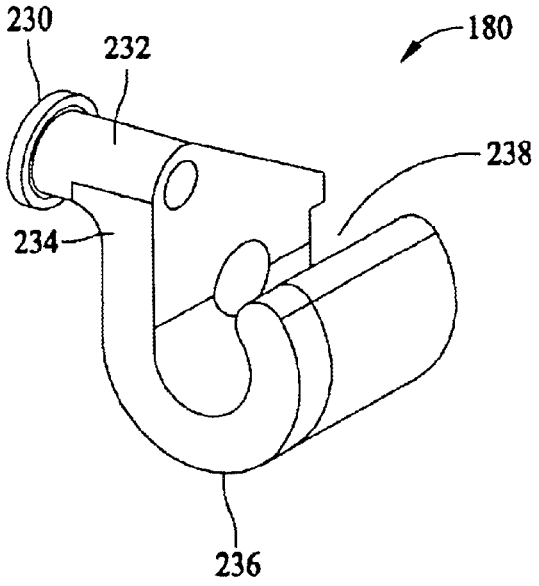
FIG. 5 is a perspective view of a hinge for the tiltable storage bin module shown in FIGS. 2 and 3.

FIG. 5 is a perspective view of hinge 180 including a cylindrical head portion 230 of a first diameter, and a neck portion 232 of a second diameter, smaller than the first diameter, extending from head portion 230. A basket engagement portion 234 extends from hinge neck portion 232 and includes a curled lower portion 236 forming a channel 238 for snap-fit engagement to basket frame bottom members 186 (shown in FIG. 3).

Basket engagement portion 236 is formed from a resilient material to produce an interference fit with basket 162 so that basket 162 is securely coupled to hinges 180. In an exemplary embodiment, hinges 180 are formed from known plastic materials according to known methods and techniques.

Figure 6:
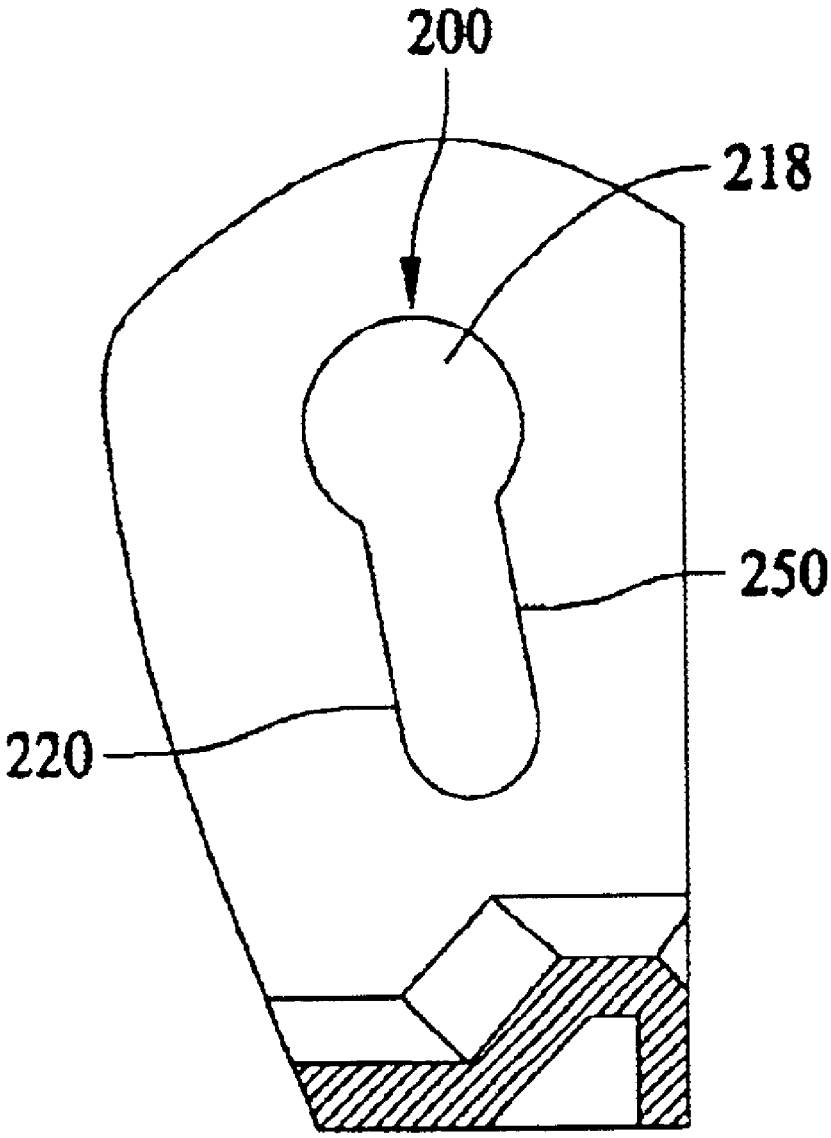
FIG. 6 is an magnified view of a portion of FIG. 4.

FIG. 6 is an magnified view of a portion of one of module base side support inner walls 214 (also shown in FIG. 4) where hinge 180 (shown in FIG. 5) is press fit into place into keyway opening 200. Keyway opening 200 includes a head portion 218 dimensioned to receive hinge head portion 230 (shown in FIG. 5) and a neck portion 220 dimensioned to receive hinge neck portion 234 (shown in FIG. 4). Thus, when hinges 180 are inserted through keyway openings 200 in each base side support, hinge head 230 is located between inner wall 214 (shown in FIG. 4) and outer wall 216 (shown in FIG. 4) of base side support forward portions 212, and hinge neck portion 232 and basket engagement portion 236 (shown in FIG. 5) extend inward through keyway opening 200 into base module channel 182 (shown in FIG. 3).

Hinge head portion 230 is inserted through keyway head portion 218 and hinge neck portion 232 is slid down keyway neck portion 220 until hinge 180 is snapped in place in a bottom of keyway neck portion 220. A small inward radius 250 is formed into one side of keyway neck portion 220 to retain hinge 180 in position once module 148 (shown in FIGS. 2 and 3) is assembled. Hinge neck portion 232 is pushed past inward radius 210 projecting into keyway neck portion 220 as hinge 180 is installed, thereby snapping hinge 180 into position in keyway 200. Once in this position past inward radius 210, hinge 180 is not easily removed from keyway 200, thereby avoiding undesirable inadvertant disassembly of module 148 in use and allowing module 148 to survive impact when accidentally dropped. A safe and rugged hinge assembly is therefore provided.

A low cost and easily assembled tiltout module 148 is therefore provided to facilitate loading and unloading of access door storage shelves with a direct and clear line of sight and access when basket 152 is tilted open. The modular unit may be easily installed and removed from the access door for cleaning, maintenance, and service. A more convenient and enjoyable refrigeration appliance is therefore realized.

While the invention has been described in terms of various specific embodiments, those skilled in the art will recognize that the invention can be practiced with modification within the spirit and scope of the claims.

What is claimed is:

1. A storage module for a refrigeration appliance, said storage module comprising:

a base comprising opposing side supports;

a basket hingedly coupled to said side supports and tiltable about a rotational axis therethrough, wherein said basket comprising a wire frame comprising at least one corner, said basket rotatably mounted to said frame at said corner; and a hinge attached to at least one of said base side supports, said hinge comprising a channel for receiving said wire frame.

2. A storage module in accordance with claim 1, said side supports comprising at least one basket stop.

3. A storage module in accordance with claim 2 wherein said basket is oriented relative to said stop to limit rotation of said basket relative to said base to about 35°.

4. A storage module for a refrigeration appliance, said storage module comprising:

a base comprising opposing side supports;

a basket hingedly coupled to said side supports and tiltable about a rotational axis therethrough, wherein at least one of said base side supports comprises a keyway; and at least one hinge received in said keyway.

5. A modular storage bin for an access door of a refrigeration appliance, said bin comprising:

a module base comprising first and second side supports configured for attachment to the access door;

at least one hinge rotatably coupled to one of said first and second side supports; and a storage basket comprising at least a bottom portion coupled to said hinge and tiltable relative to said base side supports, wherein said hinge comprises a channel therein for receiving said basket.

6. A modular storage bin in accordance with claim 5 wherein said module base further comprises at least one stop therein to prevent tilting of said basket beyond a predetermined point.

7. A modular storage bin in accordance with claim 5, said hinge further comprising a head and a neck extending therefrom, said channel extending from said neck.

8. A modular storage bin in accordance with claim 7, at least one of said base side supports comprising a keyway comprising a head portion for receiving said hinge head, and a positioning portion for receiving said neck and locating said hinge relative to said base.

9. A modular storage bin for an access door of a refrigeration appliance, said bin comprising:

a module base comprising first and second side supports configured for attachment to the access door;

at least one hinge rotatably coupled to one of said first and second side supports; and a storage basket comprising at least font and bottom sides, said bottom of said basket received in said hinge adjacent said front side, said basket selectively positionable between a substantially upright closed position and a tilted open position.

10. A storage bin in accordance with claim 9 wherein at least one of said head portion, a neck portion, and a channel portion, said basket bottom side received in said neck portion.

11. A storage bin in accordance with claim 10 wherein at least one of said module base side supports comprises a keyway for receiving said hinge head and said hinge neck.

12. A storage bin in accordance with claim 10, said base module further comprising at least one storage basket stop to prevent tilting of said basket beyond a predetermined amount.

13. A storage bin in accordance with claim 12, said basket rotatable about said hinge for about 35° between said open position and said closed position.

14. A modular storage bin for an access door of a refrigeration appliance, said bin comprising:

a module base comprising first and second side supports configured for attachment to the access door and a floor extending between said first and second side supports, said side supports comprising a basket stop portion;

a hinge rotatably coupled to each of said first and second side supports, each said hinge comprising a neck portion and a channel portion extending therefrom; and a storage basket comprising a frame comprising a front side, a bottom and first and second corners extending therebetween, said corners positioned adjacent each of said module base side supports, said basket frame received in said hinges adjacent said comas, said basket tiltable about said hinges between a substantially upright position wherein said basket is separated from said basket stop portion and a tilted position wherein said basket contacts said basket stop portion.

15. A modular storage bin in accordance with claim 14 wherein each of said hinges further comprises a head portion larger in dimension than said neck portion.

16. A modular storage bin in accordance with claim 14, said base module supports comprising a keyway for receiving said hinge head portion and said hinge neck portion.

17. A refrigeration appliance comprising:

a cabinet;

a refrigeration compartment liner within said cabinet, said liner comprising at least one refrigeration compartment;

at least one access door coupled to said cabinet for closing said refrigeration compartment, said access door comprising at least a shelf side support; and a modular storage bin coupled to said access door shelf side support, said storage bin comprising at least one hinge supported by said shelf side support and a basket received in said hinge, said basket rotatable about said hinge between an upright closed position and a tilted open position providing a direct line of access into said basket.

* * * * *

UNITED STATES PATENT AND TRADEMARK OFFICE

CERTIFICATE OF CORRECTION

PATENT NO. : 6,799,818 B2
DATED : October 5, 2004
INVENTOR(S) : Ahmed et al.

It is certified that error appears in the above-identified patent and that said Letters Patent is hereby corrected as shown below:

Column 8,
Line 19, delete “least font” and insert -- least front --.
Lines 24-25, delete “at least one of said” and insert -- said hinge comprises a --.
Line 52, delete “comas” and insert -- corners --.

Signed and Sealed this

Second Day of May, 2006

JON W. DUDAS
*Director of the United States Patent and Trademark Office*